US006192805B1

(12) United States Patent
Saylor et al.

(10) Patent No.: US 6,192,805 B1
(45) Date of Patent: Feb. 27, 2001

(54) STORAGE BIN FOR WORKSTATION

(75) Inventors: Charles Saylor, Grand Rapids, MI (US); Sheldon Phillips, Thousand Oaks; Edward Mitchell, Los Angeles, both of CA (US)

(73) Assignee: Haworth, Inc., Holland, MI (US)

( * ) Notice: Subject to any disclaimer, the term of this patent is extended or adjusted under 35 U.S.C. 154(b) by 0 days.

(21) Appl. No.: 09/318,869

(22) Filed: May 26, 1999

(51) Int. Cl.[7] ..... A47B 85/00

(52) U.S. Cl. ..... 108/26; 108/50.02; 312/223.6

(58) Field of Search ..... 108/25, 26, 50.01, 108/50.02; 312/223.1, 223.3, 223.6, 258, 259, 245, 246, 248

(56) References Cited

U.S. PATENT DOCUMENTS

| | | | | |
|---|---|---|---|---|
| 2,140,685 | | 12/1938 | Baxter . | |
| 2,241,309 | | 5/1941 | Kovalik . | |
| 2,764,461 | * | 9/1956 | Montgomery | 312/245 X |
| 3,034,153 | | 5/1962 | Sargent . | |
| 3,042,467 | | 7/1962 | Germick . | |
| 3,193,341 | * | 7/1965 | Preston | 312/245 |
| 4,066,306 | * | 1/1978 | Klinder | 312/245 X |
| 4,792,881 | * | 12/1988 | Wilson et al. | 312/223.6 X |
| 4,827,850 | * | 5/1989 | Diffrient | 108/50.02 X |
| 4,974,620 | | 12/1990 | Quillan et al. . | |
| 5,231,562 | * | 7/1993 | Pierce et al. | 108/50.02 X |
| 5,272,988 | * | 12/1993 | Kelley et al. | 108/50.02 |
| 5,337,657 | * | 8/1994 | Diffrient | 108/50.02 X |
| 5,800,027 | * | 9/1998 | Dunn | 312/245 X |
| 5,809,900 | | 9/1998 | Alexander et al. . | |
| 5,934,201 | * | 8/1999 | Diffrient | 108/50.02 |
| 5,971,509 | * | 10/1999 | Deimen et al. | 108/26 X |
| 6,003,447 | * | 12/1999 | Cox et al. | 108/50.02 |

FOREIGN PATENT DOCUMENTS

| | | | | |
|---|---|---|---|---|
| 1590188 | * | 6/1970 | (DE) | 312/223.6 |
| 2279002 | * | 12/1994 | (GB) | 312/223.6 |

OTHER PUBLICATIONS

Architectural Record, "Teamwork Kit–of–Parts", May 1995 (1 page).
Facilities Design & Management, "Hotline", May 1995 (2 pages).
Contract Design, The Future Arrives–in 1995?, May 1995 (1 page).

* cited by examiner

*Primary Examiner*—Peter M. Cuomo
*Assistant Examiner*—Hanh V. Tran
(74) *Attorney, Agent, or Firm*—Flynn, Thiel, Boutell & Tanis, P.C.

(57) ABSTRACT

A storage bin for storage and containment of cabling associated with work-related items such as computers, telephones and the like. The storage bin is mountable generally along a terminal edge of a furniture component such as a worksurface, so that cabling can be routed from atop the worksurface downwardly into a hollow interior of the bin. The storage bin additionally includes pairs of overlapping side walls at each end of the bin which are movable relative to one another to enable opening and closing of the bin when mounted on the worksurface.

21 Claims, 4 Drawing Sheets

STORAGE BIN FOR WORKSTATION

FIELD OF THE INVENTION

This invention relates to a bin for storage and containment of wires and cables associated with work-related items such as computers, telephones and the like, and particularly to a bin or container intended for mounting adjacent the edge of a furniture component, such as a table defining a worksurface thereon, which bin efficiently utilizes space generally beneath the worksurface to safely and neatly store wires or cables.

BACKGROUND OF THE INVENTION

The modern office environment has ever increasing demands with respect to not only the availability of effective work space, particularly in association with a worksurface, but also the efficient or effective utilization of available space around a worksurface. In addition, the widespread use of computers, printers and telecommunication equipment in the workplace and also in the home generally results in an excessive amount of wiring and cabling on and around the associated worksurface.

With regard to office-type environments, conventional wall panels which are frequently used to construct workstations typically include interior passages and storage areas for management of electrical and communication cables being routed to each workstation. However, to provide more flexibility in office areas, workstations are also being formed by arrangements of readily movable components such as freestanding tables, divider screens, and freestanding cabinets which open to define a workstation. Unlike wall panel arrangements, these transportable furniture components typically do not include separate storage chambers for electrical, communication and computer cabling. The excessive amount of wiring and/or cabling, and the lack of proper storage compartments provided in transportable furniture components can result in cluttering of the worksurface which is not only unsightly, but is also undesirable with respect to safety considerations.

Accordingly, it is an object of this invention to provide an improved accessory which can be used in conjunction with a workstation furniture component such as a table, and which provides for the convenient and safe storage of cabling and wiring associated with electronic components such as computers and telephones in a manner so as not to interfere with the available space on the worksurface.

The invention relates to a storage bin for storing cabling associated with a workstation, which bin includes horizontally spaced front and rear walls, a bottom wall extending between the front and rear walls and a pair of side walls, which walls together define a hollow interior which opens upwardly through an open upper end of the bin. The storage bin also includes a mounting arrangement adapted for securing same to a worksurface adjacent a terminal edge portion thereof. The front wall defines therein a cable port in communication with the hollow interior and defining part of the open upper end of the bin. The storage bin is movable into an open configuration for providing access to the hollow interior thereof via the open upper end, and a closed configuration wherein the open upper end is partially closed off. The part of the open upper end defined by the cable port is positioned generally below the terminal edge portion of the worksurface in the closed configuration of the bin such that the cabling supported on the worksurface adjacent the terminal edge portion thereof is routable downwardly into the hollow interior through the cable port.

The invention also relates to a storage bin for storing cabling associated with a workstation having opposed front and rear walls, a bottom wall extending between lower edge portions of the front and rear walls, and a pair of side walls interconnecting the front and rear walls. The walls define a generally hollow interior of the bin which opens upwardly through an open upper end. Also included is a mounting arrangement adapted for securing the bin to a worksurface. Each of the side walls is embodied by a pair of overlapping side wall parts connected to generally upright side edges of the respective front and rear walls. Each of the side wall parts connected to the front wall are fixedly but slidably attached to the respective adjacent side wall part connected to the rear wall such that the front wall and its respective side wall parts are swingably removable relative to the rear wall and its respective side wall parts to permit the bin to be moveable into an open configuration for receiving cabling therein through the open upper end, and a closed configuration for storing cabling therein.

The desirable constructional and functional features of the present invention, as well as other operational advantages thereof, will be apparent upon reading the following specification and inspecting the accompanying drawings.

Figure 1:
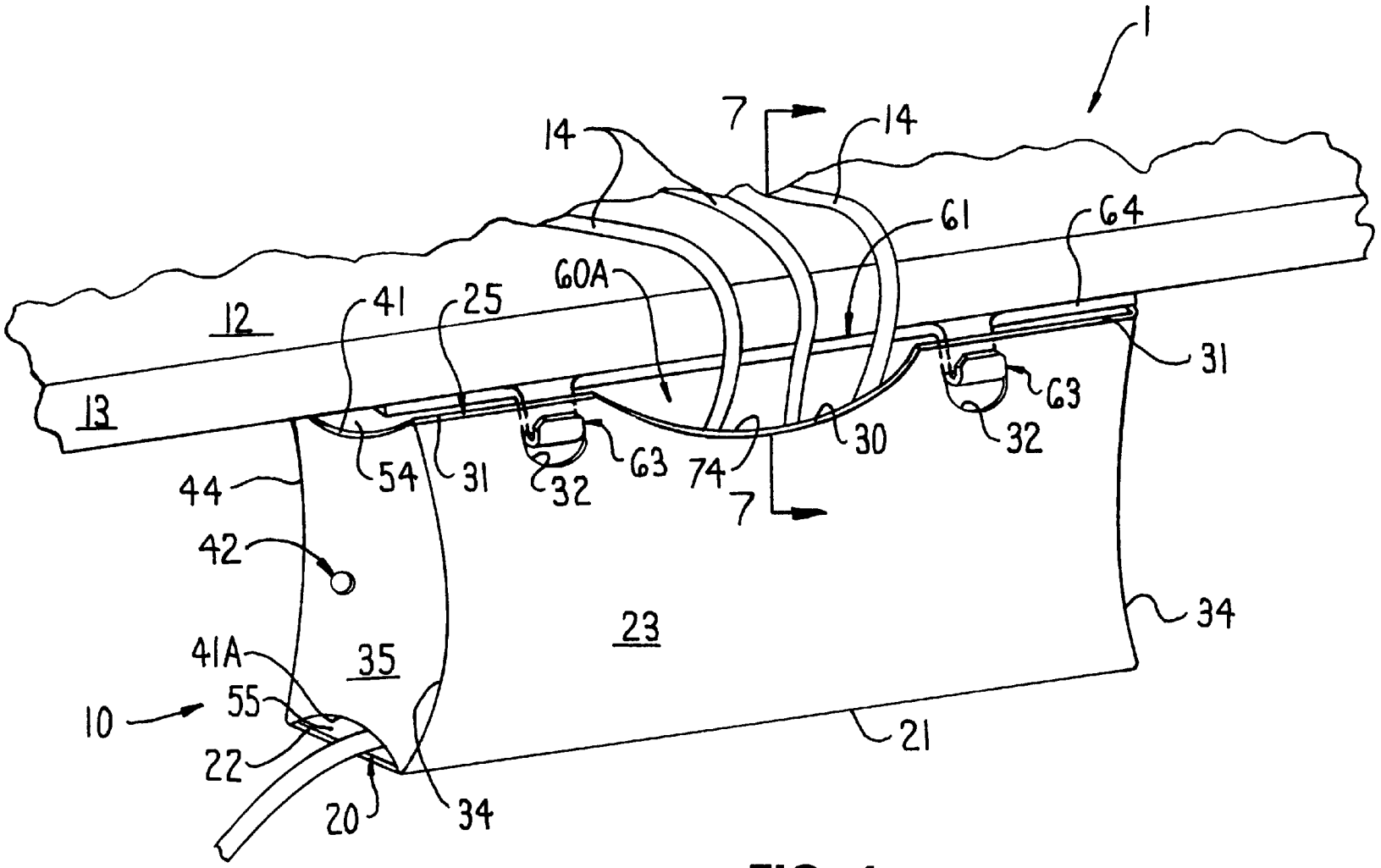
FIG. 1 is a perspective view which illustrates a storage bin according to the invention mounted adjacent an edge of a worksurface and in a closed configuration for storage of wires or cabling therein.

Certain terminology will be used in the following description for convenience and reference only, and will not be limiting. For example, the words "upwardly", "downwardly", "rightwardly" and "leftwardly", will refer to directions in the drawings to which reference is made. The word "front" when used in relation to the worksurface will refer to the side of the worksurface which is typically closest to the worker, and the word "rear" when used in relation to the worksurface will refer to the side which is remote from the worker. The word "front" when used in relation to the storage bin will refer to the outer exposed side of the bin when mounted adjacent an edge of a worksurface, and the word "rear" will refer to the opposite side of the bin. The words "inwardly" and "outwardly" will refer to directions toward and away from, respectively, the geometric center of the arrangement or the specific parts thereof. Said terminology will include the words specifically mentioned, derivatives thereof, and words of similar import.

DETAILED DESCRIPTION

Referring to FIGS. 1–4, there is illustrated a storage bin 10 according to the invention, which storage bin 10 is particularly adapted for use in association with a worksurface 11 such as a table supported in upwardly spaced relation from a floor by one or more upright legs (not shown). The worksurface 11 defines thereon an enlarged and generally horizontally oriented upper surface 12, and a lower surface 12A opposite upper surface 12. The worksurface 11 terminates in a longitudinally extending rear edge 13 which is remote from the side of the worksurface 11 which is normally closest to the worker. Office equipment, such as a computer, telephone, lighting and the like are typically supported on upper surface 12. These types of devices typically require connection to electrical or communication wiring or cabling 14, and in some cases both.

To facilitate management of such cabling 14 which typically has a surplus length, one or more storage bins 10 according to the invention are mounted to the worksurface 11 along one of the terminal edges thereof. In the illustrated embodiment, the storage bin 10 is mounted so as to extend along the rear edge 13 of worksurface 11, which is an optimal location for a typical workstation wherein the cabling connected to various types of electronic equipment lies atop the rear part of the upper surface 12 and then drops down over the rear edge 13 for connection to an electrical outlet, extension cord, power strip, etc. However, it may be desirable to mount the storage bin 10 along one of the other edges of the worksurface 11 depending upon the particular location of the equipment supported thereon.

Figure 5:
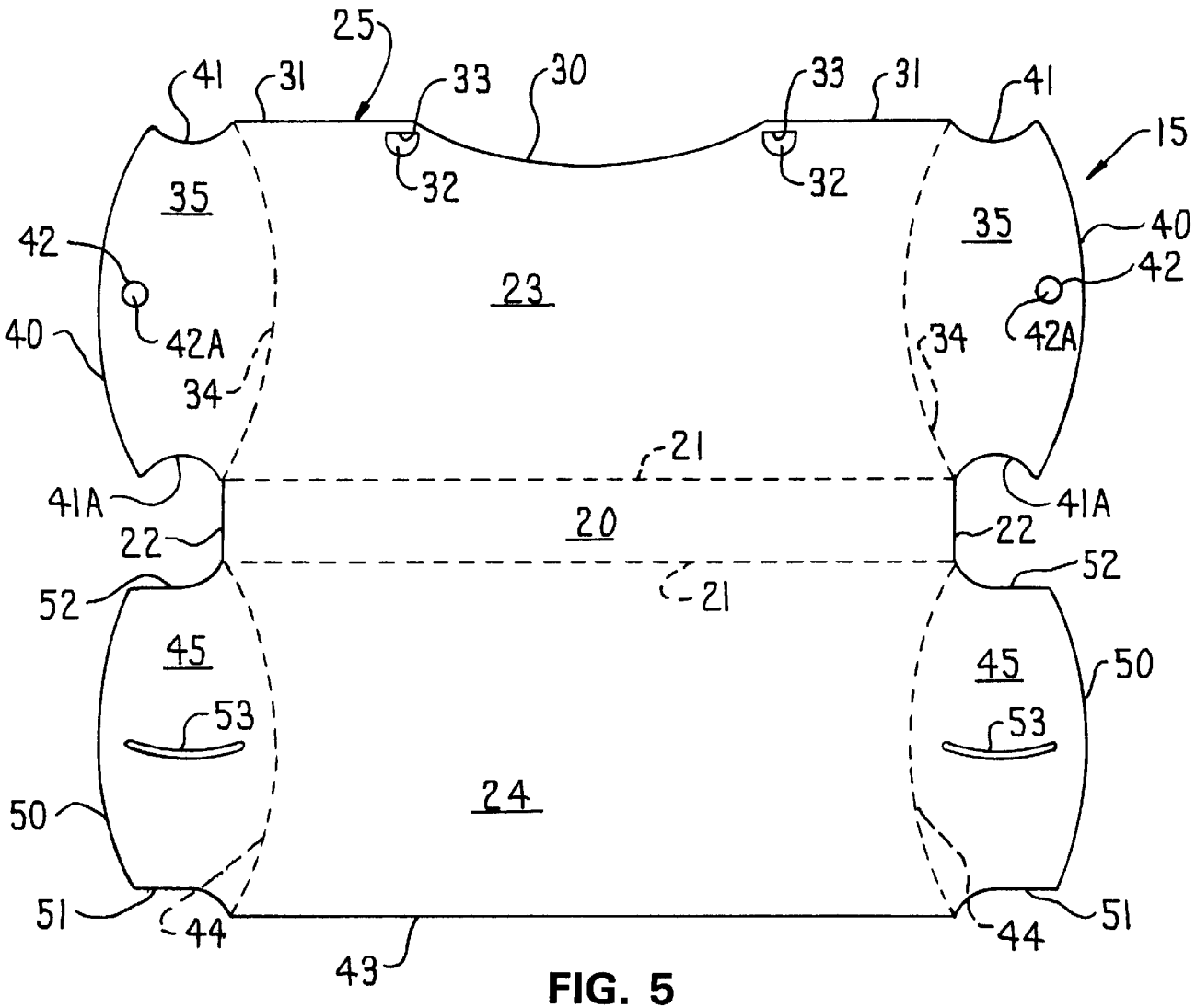
FIG. 5 is a sheet or blank from which the storage bin according to the invention may be formed.

Referring to FIG. 5, for convenience in manufacturing, the storage bin 10 in the illustrated embodiment is formed of a thin, unitary and semi-rigid sheet 15 of plastic material, such as polypropylene. The sheet 15 has limited flexibility and is foldable to define the overall shape of the storage bin 10 as shown in FIG. 1. Referring now to both FIGS. 1 and 5, the storage bin 10 includes an elongate and planar bottom wall 20 of generally rectangular shape. The bottom wall 20 has a pair of generally parallel longitudinal side edges 21 which are defined by fold lines or creases shown in dotted lines in FIG. 5, and a pair of generally parallel free side edges 22. The storage bin 10 additionally includes front and rear walls 23 and 24 spaced horizontally from one another and having lower edges which are joined to opposite side edges 21 of bottom wall 20. Front wall 23 includes an upper free edge 25 having a generally centrally located, upwardly opening, shallow arcuate recess 30 bordered on both sides by straight edge portions 31 which are generally parallel to side edges 21. A pair of generally semi-circular openings 32 extend through front wall 23 and are located close to upper free edge 25 thereof on either side of recess 30 slightly below the respective straight edge portions 31. The openings 32 are defined in part by straight top edges 33 (FIG. 2) which are generally parallel to edge portions 31.

Figure 6:
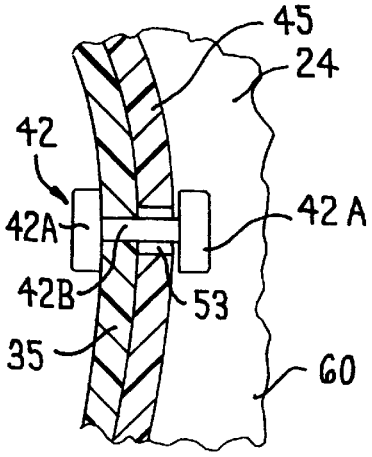
FIG. 6 is an enlarged, fragmentary, cross-sectional view taken generally along line 6—6 in FIG. 3.

Front wall 23 has a pair of generally vertically oriented and concavely curved side edges 34 which extend between upper free edge 25 and the lower edge of front wall 23 or fold line 21. The side edges 34 are defined by fold lines or creases shown in dotted lines in FIG. 5. A pair of generally vertically oriented side wall parts or flaps 35 are joined to opposite side edges 34 of front wall 23 through fold lines 34. Each side wall part 35 includes an outer convexly curved free side edge 40 which, in combination with the respective side edge 34, provides the side wall parts 35 with a football-like shape. Side wall parts 35 each have a top edge 41 having a shallow concave shape of approximately the same vertical depth as recess 30 of front wall 23, and a bottom edge 41A having an identical, but inverted, configuration as top edge 41. A fastener 42 is provided on each side wall part 35 adjacent side edge 40 and approximately midway thereal-ong. More specifically, the respective fasteners 42 are located approximately the same distance from the top and bottom edges 41 and 41A of the respective side wall parts 35, but are offset horizontally toward the respective free side edge 40. The fasteners 42, in the illustrated embodiment, have a pair of enlarged heads 42A (FIG. 6) connected to one another by a neck or stem portion 42B of a reduced diameter. Fasteners 42 extend through the respective side wall part 35 such that the heads 42A thereof are located on opposite sides of side wall part 35. Fasteners 42 may be constructed of a rigid but lightweight material, such as plastic.

Figure 3:
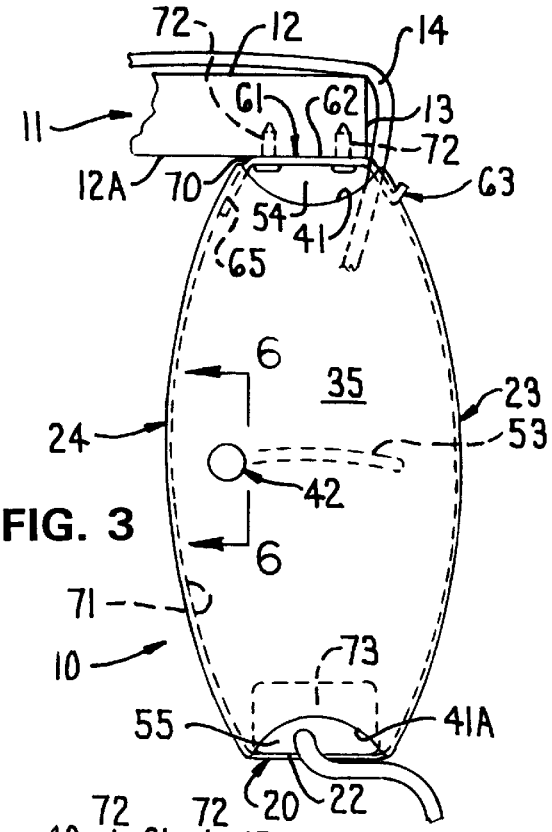
FIG. 3 is an enlarged elevational end view of the storage bin in a closed configuration.
Figure 4:
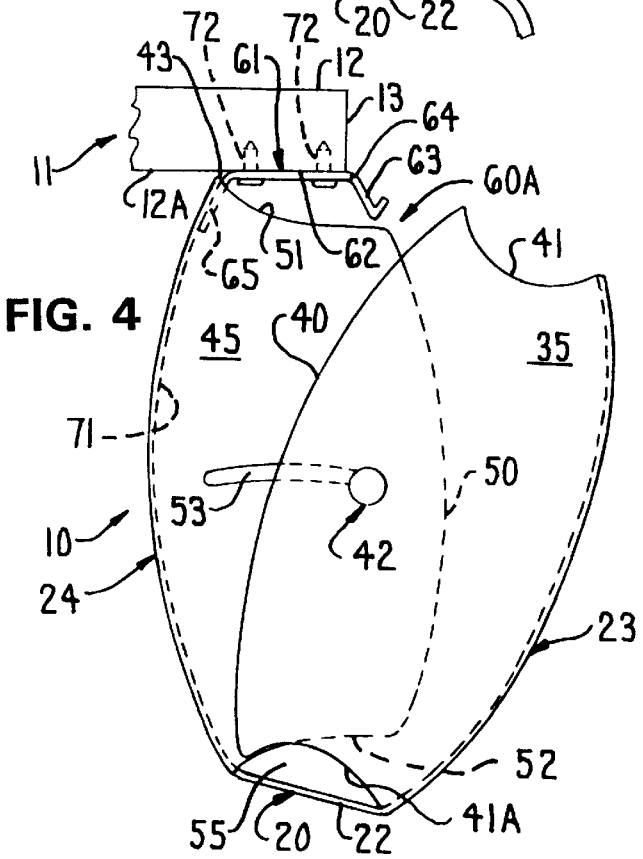
FIG. 4 is a view similar to FIG. 3, but illustrating the storage bin in an open configuration.

Rear wall 24 is similar in shape to front wall 23 and has a top free edge 43 generally parallel to the respective longitudinal side edge 21 of bottom wall 20, and a pair of concavely curved side edges 44 which extend between top edge 43 and the respective side edge 21 of bottom wall 30 and are defined by fold lines or creases shown in dotted lines in FIG. 5. A pair of side wall parts or flaps 45 similar to side wall parts 35 are joined to opposite side edges 44 of rear wall 24 through fold lines. Each side wall part 45 includes an outer convexly curved free side edge 50 which, in combination with the respective side edge 44, provides the side wall parts 45 with a football-like shape. With reference to FIG. 4, side wall parts 45 each have a top edge 51 which extends generally horizontally rearwardly from the outer free side edge 50 of the side wall part 45 and then curves generally upwardly toward the top free edge 43 of rear wall 24, and a bottom edge 52 having an identical, but inverted, configuration as top edge 51. A shallow and downwardly arcuate slot 53 (FIGS. 3 and 4) is provided in each side wall part 45 in a generally central position so as to cooperate with the fastener 42 of the adjacent respective side wall part 35. The slots 53 are preferably of a size which enables sliding movement of the neck portions 42B of the respective fasteners 42 therein as discussed below.

The storage bin 10 may be assembled as follows with reference to FIG. 5. The front and rear walls 23 and 24 are bent or folded upwardly about the respective fold lines 21, and are connected to one another by folding the respective pairs of side wall parts 35 and 45 inwardly towards one another about the respective fold lines 34 and 44 and inserting the innermost head 42A of fasteners 42 of the side wall parts 35 into the respective slots 53 of adjacent side wall parts 45 so as to fasten the respective pairs of side wall parts 35 and 45 to one another in an overlapping fashion. The neck portions 42B of the fasteners 42 are slidable within the respective slots 53 so that front wall 23 and the respective side wall parts 35 can be moved between an open configuration (FIGS. 2 and 4) and a closed configuration (FIGS. 1 and 3). The front, rear, bottom and side walls together provide the bin 10 with a hollow interior 60 which opens upwardly through an open upper end 60A. Once assembled, the top recessed edges 41 and 51 of the pairs of overlapping side wall parts 35 and 45 cooperate to define upper cable ports 54, and the bottom recessed edges 41A and 52 of the pairs of overlapping side wall ports 35 and 45 cooperate to define lower cable ports 55. Thus, an upper port 54 and a lower cable port 55 are located on each side of storage bin 10 for communication with the hollow interior 60 thereof. It will be appreciated that once the sheet 15 is folded and the side wall parts 35 and 45 are connected to one another as discussed above, the bin 10 retains the overall shape as shown in FIGS. 1–4 due to the semi-rigid nature of the plastic material from which it is constructed. Further, the fold lines or creases 21, 34, and 44 may be formed by scoring sheet 15 with a knife or blade.

To mount the storage bin 10 on the worksurface 11, an elongate mounting bracket 61 is provided which is constructed of a rigid lightweight material, for example acrylic plastic. Mounting bracket 61 includes an elongate and generally flat top wall 62. A pair of upwardly opening hooks 63 are fixed to a longitudinal front edge 64 of top wall 62 and project outwardly and angle downwardly therefrom for cooperation with the respective openings 32 of front wall 23. Mounting bracket 61 also has an elongate flange 65 which projects generally downwardly from a longitudinal rear edge 70 of top wall 62. This flange 65 is preferably fixed to an inner surface 71 of rear wall 24 along the top edge 43 thereof, for example by adhesive, so that the top wall 62 of mounting bracket 61 substantially closes off the open upper end 60A of the storage bin 10. It will be appreciated that other methods of securing flange 65 to rear wall 24 may be employed, such as rivets.

In the illustrated embodiment, the storage bin 10 is mounted to the worksurface 11 by threaded fasteners 72 which extend through the top wall 62 of mounting bracket 61 and into the lower surface 12A of worksurface (FIGS. 3 and 4). It will be understood that other types of fastening arrangements may be utilized to mount storage bin 10 on worksurface 11, such as touch and close fastening systems. One example of such a system is a commercial grade fastener including a pair of mating tapes each having adhesive on one side and spikes projecting outwardly from the opposite side, which spikes have an enlarged head on the free end thereof. One of the tapes has a larger number of spikes thereon so that when the tapes are pressed together, the enlarged heads of the respective tapes interlock and securely fix the tapes together until they are peeled apart. Another type of touch and close fastening system which may be utilized is a hook and loop type fastener commonly sold under the name VELCRO® (depending upon the size of the bin 10).

As best shown in FIGS. 1–4, with the storage bin 10 mounted on the worksurface 11, same is positionable in a closed position (FIGS. 1 and 3) wherein the hooks 63 project through the respective openings 32 in front wall 23 so as to supportingly engage the top edges 33 thereof. In this closed position, the side wall parts 35 and 45 substantially completely overlap one another and the fasteners 42 are positioned at the rearwardmost terminal ends of the respective slots 53 (FIG. 3). To open the storage bin 10, the user grips the upper free edge 25 of front wall 23 and slightly lifts same so as to disengage the hooks 63 from the respective openings 32. The front wall 23 is then pulled outwardly which causes side wall parts 35 to slide forwardly relative to the respective side wall parts 45. This sliding movement of side wall parts 35 is guided by the fasteners 42 which move within the respective slots 53 of side wall parts 45. In the fully open position, the fasteners 42 are positioned at the forwardmost terminal ends of the slots 53 (FIG. 4). Further, in the fully open position of bin 10, the bottom wall 20 angles slightly downwardly relative to the horizontal, and the lower cable ports 55 remain open and in communication with the interior 60 of the storage bin 10. Thus, the front wall 23 and the respective side wall parts 35 normally at least partially pivot about the lower edge or fold line 21 of rear wall 24 as the bin 10 is opened.

Figure 2:
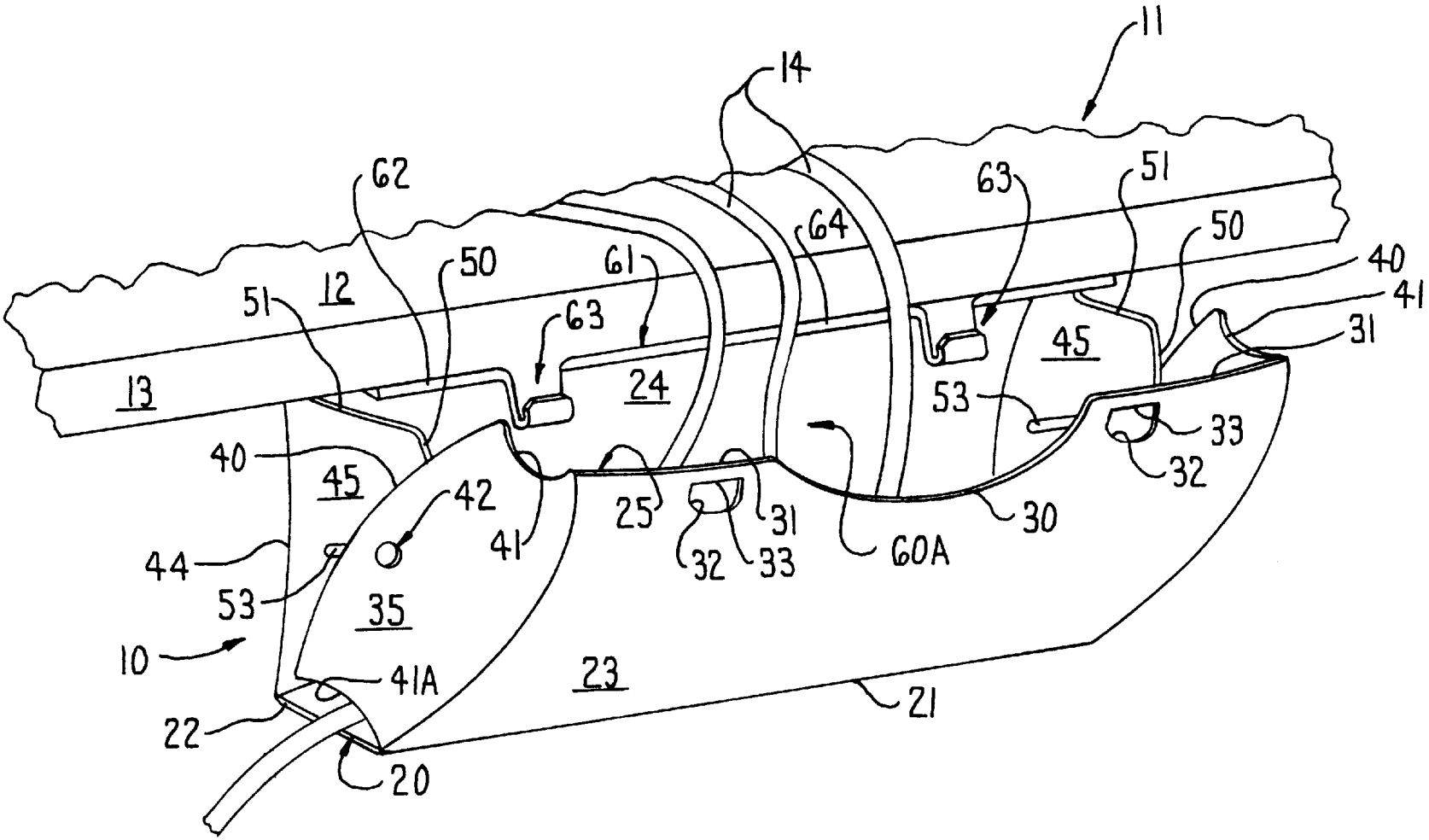
FIG. 2 is a view similar to FIG. 1 but showing the storage bin in an open configuration to provide access to the interior thereof.

As shown in FIG. 2, with the bin 10 in the open configuration, cabling 14 supported on the upper surface 12 of the worksurface 11 is dropped over the rear edge 13 thereof and into the interior 60 of the bin 10. If desired or necessary, a conventional plug strip 73 (shown in dotted lines in FIG. 3) may be disposed within interior 60 and supported on bottom wall 20, for example. Other types of receptacles or articles can also be stored within the bin 10. The bin 10 can then be closed by grasping front wall 23 and pushing same toward rear wall 24 while simultaneously lifting front wall 23 slightly upwardly so as to engage hooks 63 within the respective openings 32.

Figure 7:
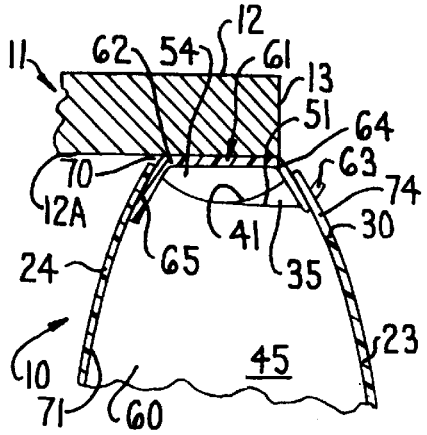
FIG. 7 is an enlarged, fragmentary cross-sectional view taken generally along line 7—7 in FIG. 1.

The front and rear walls 23 and 24 in the assembled condition of the storage bin 10 have a generally convex configuration when viewed from the side, as best shown in FIGS. 3 and 4. This convex configuration of the front wall 23 and the recess 30 formed along the top edge 25 thereof cooperate to define an upper cable receiving port 74 which projects horizontally outwardly from the front edge 64 of the mounting bracket 61 and worksurface edge 13 when the bin 10 is in the closed configuration (FIG. 7). In this regard, the cabling 14 extends from the upper surface 12 of the worksurface 11, over rear edge 13 and downwardly into the cable port 74 as best shown in FIG. 3.

With the above-described arrangement, coiled loops or lengths of excess cabling 14 can be stored and restrained within the hollow interior 60 of the storage bin 10, and the storage bin 10 according to the invention offers a number of entry and exit locations including cable port 74, upper cable ports 54, and lower cable ports 55.

It will be appreciated that the storage bin 10 disclosed herein need not necessarily be constructed from a unitary sheet 15, and may alternatively be constructed of separate wall parts which are appropriately fastened together with adhesive, rivets or other fasteners. However, the sheet construction of the bin 10 enables shipping thereof in a generally flat condition.

It will also be appreciated that the size of the storage bin 10 according to the invention may be varied depending upon the intended location of the bin 10 and the amount of cabling and/or wiring to be stored therein.

Further, it will be understood that fasteners 42 may instead be located on side wall parts 45 and slots 53 located on side wall parts 35. In addition, fasteners 42 need not necessarily be double-headed and may instead include a single enlarged head for engagement within the respective slot and the end of the neck or stem portion of the fastener opposite the single head can then be fixed to the surface of the side wall part. Other methods of slidably attaching side wall parts to one another may also be utilized.

Although a particular preferred embodiment of the invention has been disclosed in detail for illustrative purposes, it will be recognized that variations or modifications of the disclosed apparatus, including the rearrangement of parts, lie within the scope of the present invention.

What is claimed is:

1. A workstation comprising:

a worksurface defining generally horizontally enlarged and oppositely facing upper and lower surfaces and a terminal edge portion which defines part of an outer periphery of said worksurface; and a storage bin for storing cabling associated with the worksurface, said bin comprising:

opposed front and rear walls horizontally spaced from one another, a bottom wall extending between lower edge portions of said front and rear walls, and a pair of side walls interconnecting said front and rear walls, said walls together defining a generally hollow interior which opens upwardly through a cable port defined in part by a top edge of said front wall;

a mounting arrangement fixed to said bin and adapted for securing said bin to said lower surface of said worksurface proximate said terminal edge portion thereof;

said bin being movable into an open configuration for providing access to said hollow interior thereof and a closed configuration wherein said hollow interior is partially closed off, said cable port being positioned generally below the terminal edge portion of the worksurface in said closed configuration of said bin such that cabling supported on the worksurface adjacent the terminal edge portion thereof can be routed downwardly along said terminal edge portion and into said hollow interior through said cable port.

2. The workstation of claim 1 wherein said cable port projects horizontally outwardly beyond the terminal edge portion of the worksurface in said closed configuration of said bin.

3. The workstation of claim 1 wherein said cable port is defined by an upwardly opening recess in said top edge of said front wall which is spaced downwardly from the terminal edge portion of the worksurface, said recess having a shallow, upwardly arcuate configuration.

4. The workstation of claim 1 wherein said cable port is an upper cable port and at least one of said side walls defines therein a lower cable port in communication with said interior for routing cabling into and out of said interior.

5. The workstation of claim 4 wherein each said side wall defines therein a lower cable port adjacent said bottom wall in communication with said interior and an additional upper cable port spaced upwardly from the respective lower cable port adjacent the lower surface of the worksurface.

6. The workstation of claim 1 wherein said front, rear, bottom and side walls are formed from a single, unitary thin sheet of material.

7. The workstation of claim 1 wherein said front wall defines a pair of openings therein adjacent said top edge thereof, said mounting arrangement including an elongate mounting part having a front edge generally parallel to the terminal edge portion of the worksurface, and a pair of hooks project outwardly and angle downwardly from said front edge for engagement with the respective openings in said front wall in said closed configuration of said bin.

8. The workstation of claim 7 wherein said mounting part includes a flange which projects outwardly and angles downwardly from a rear edge of said mounting part spaced horizontally from said front edge, said flange being fixed to said rear wall.

9. A storage bin for storing cabling associated with a workstation, said bin comprising:

opposed front and rear walls horizontally spaced from one another, a bottom wall extending between lower edge portions of said front and rear walls, and a pair of side walls interconnecting said front and rear walls, said walls together defining a generally hollow interior of said bin which opens upwardly; and a mounting arrangement adapted for securing said bin to the underside of a worksurface;

each said side wall including first and second overlapping side wall parts respectively connected to and projecting outwardly from generally upright opposite side edges of said front and rear walls, each said first side wall part being fixedly but slidably attached to the respective second side wall part such that said first side wall parts and said front wall are swingably movable outwardly relative to the respective said second side wall parts and said rear wall to permit said bin to be movable into and maintained in an open configuration for providing access to said interior, said first side wall parts and said front wall being swingably movable toward the respective said second side wall parts and said rear wall into a closed configuration for closing off said interior.

10. The storage bin of claim 9 wherein one side wall part of each overlapping pair of side wall parts defines therein a shallow downwardly arcuate slot, and the other side wall part of each overlapping pair of side wall parts mounts thereon a fastener in a location corresponding to said slot of the respective one side wall part, said fastener being engaged within the respective slot to enable guided movement of said first side wall parts relative to the respective second side wall parts.

11. The storage bin of claim 9 wherein each said side wall defines therein an upper cable port adjacent the underside of the worksurface and a lower cable port adjacent said bottom wall for selective routing of cabling into and out of said interior.

12. The storage bin of claim 9 wherein said front wall defines a pair of openings therein adjacent a top edge thereof, said mounting arrangement including a mounting part fixed to said rear wall and securable to the underside of the worksurface, said mounting part being elongate and having a front edge generally parallel to and generally vertically aligned with a terminal edge portion of the worksurface and disposed closely adjacent thereto, and a pair of hooks project generally downwardly from said front edge for engagement with the respective openings in said front wall to maintain said bin in said closed configuration.

13. The storage bin of claim 9 wherein said mounting arrangement includes a mounting part fixed to said rear wall of said bin and securable to a generally horizontally oriented underside of the worksurface, said bin in said closed configuration is disposed substantially completely beneath the worksurface and in said open configuration said front wall and said first side wall parts project horizontally outwardly from a terminal edge portion of the worksurface.

14. The storage bin of claim 9 wherein said front and rear walls have a generally convex configuration to provide said bin with a generally football-like shape when viewed from one end thereof, said front wall defining therein an upwardly opening recess extending along a top edge thereof which defines a cable port for receiving cabling therein.

15. The storage bin of claim 9 wherein said first and second side wall parts project outwardly from and beyond the respective front and rear walls, and each said first side wall part is attached to the respective second side wall part by a fastening structure which maintains said bin in said open configuration.

16. A storage bin formed from a thin sheet of material comprising:

a bottom wall disposed generally centrally of said sheet and having a generally rectangular shape, said rectangular shape being defined by a pair of generally parallel longitudinal edges and a pair of generally parallel free side edges;

front and rear walls connected to said bottom wall along the respective longitudinal edges thereof and being foldable upwardly from said bottom wall about said longitudinal edges such that said front and rear walls are upright and horizontally spaced from one another, said front and rear walls each having an upper free edge and a pair of generally vertically oriented side edges extending between said bottom wall and the respective upper free edge;

a first pair of side wall flaps connected to said front wall along the respective vertical side edges thereof and being foldable inwardly about said side edges of said front wall such that said first side wall flaps are oriented transversely relative to said front wall;

a second pair of side wall flaps connected to said rear wall along the respective side edges thereof, said second side wall flaps being foldable inwardly about said rear wall side edges such that said second side wall flaps overlie the respective first side wall flaps, whereby the overlying pairs of first and second side wall flaps define respective first and second side walls of said bin;

a mounting bracket including a first mounting part fixed to said rear wall and a second generally horizontally oriented mounting part which is securable to a generally horizontally oriented underside of a worksurface;

said front, rear, bottom and first and second side walls together defining a generally hollow interior which opens upwardly through an open upper end of said bin for receiving cabling therein, and at least one of first and second side walls defining a cable port therein for routing cabling into and out of said hollow interior;

each said first side wall flap being fixedly but slidably attached to the respective second side wall flap to enable limited swinging movement of said front wall and said first side wall flaps away from said rear wall and said second side wall flaps into an open configuration, and limited swinging movement of said front wall and said first side wall flaps toward said rear wall and said second side wall flaps into a closed configuration.

17. The storage bin of claim 16 wherein said cable port is defined by overlapping upwardly recessed lower edges of the respective first and second side wall flaps.

18. The storage bin of claim 16 wherein both said first and second side walls define therein a cable port, said cable ports being defined by overlapping upwardly recessed lower edges of the respective first and second side wall flaps.

19. The storage bin of claim 18 wherein said cable ports are lower cable ports, and each said first and second side wall defines therein an upper cable port defined by overlapping downwardly recessed upper edges of the respective first and second side wall flaps.

20. The storage bin of claim 16 wherein said thin sheet of material comprises polypropylene.

21. The storage bin of claim 16 wherein said front wall defines a pair of openings therein adjacent said upper free edge thereof, said second mounting part is elongate and has a front edge generally parallel to a terminal edge portion of the worksurface and disposed closely adjacent thereto, and a pair of hooks project generally downwardly from said front edge for engagement within the respective openings in said front wall in said closed configuration of said bin.

* * * * *